US008806990B1

(12) United States Patent
Chen

(10) Patent No.: US 8,806,990 B1
(45) Date of Patent: Aug. 19, 2014

(54) HANDTOOL HAVING BENDING MECHANISM

(71) Applicant: Hui-Chien Chen, Taichung County (TW)

(72) Inventor: Hui-Chien Chen, Taichung County (TW)

( * ) Notice: Subject to any disclaimer, the term of this patent is extended or adjusted under 35 U.S.C. 154(b) by 0 days.

(21) Appl. No.: 14/189,104

(22) Filed: Feb. 25, 2014

Related U.S. Application Data

(63) Continuation-in-part of application No. 13/851,841, filed on Mar. 27, 2013.

(51) Int. Cl.
*B25B 23/16* (2006.01)
*B25G 1/00* (2006.01)

(52) U.S. Cl.
USPC ..... 81/177.1; 81/177.7; 81/177.8

(58) Field of Classification Search
USPC ..... 81/177.7, 63.1, 177.2, 177.6, 177.8, 81/177.9
See application file for complete search history.

(56) References Cited

U.S. PATENT DOCUMENTS

| | | | | |
|---|---|---|---|---|
| 6,148,698 | A * | 11/2000 | Hsieh | 81/177.8 |
| 6,216,567 | B1 * | 4/2001 | Hu | 81/177.9 |
| 6,220,125 | B1 * | 4/2001 | Lan | 81/177.9 |
| 6,324,947 | B2 * | 12/2001 | Jarvis | 81/177.2 |
| 6,336,383 | B1 * | 1/2002 | Hung | 81/60 |
| 6,386,075 | B1 * | 5/2002 | Shiao | 81/177.8 |
| 2012/0186401 | A1 * | 7/2012 | Chen | 81/60 |

* cited by examiner

*Primary Examiner* — Monica Carter
*Assistant Examiner* — Danny Hong

(57) ABSTRACT

A handtool includes a first element and a second element. A pivot end of the first element is pivotably disposed on a pivot trough of the second element wherein the pivot trough having a lateral breach. The pivot end is able to slide in the pivot trough between a restriction position and a pivotable position along a longitudinal direction of the second element. When the pivot end is located at the restriction position, the pivot end is hindered by the bottom of the pivot trough so as to fail to pivot with respect to the pivot trough. When the pivot end is located at the pivotable position, the pivot end is away from the bottom of the pivot trough so as to be pivotable via the breach. As a result, the present invention is easy to bend for use.

7 Claims, 7 Drawing Sheets

HANDTOOL HAVING BENDING MECHANISM

FIELD OF THE INVENTION

The present invention is a CIP of application Ser. No. 13/851,841, filed Mar. 27, 2013, the entire contents of which are hereby incorporated by reference.

BACKGROUND OF THE INVENTION

Description of the Prior Art

Hand tools are wildly used in maintenance of machinery industry. But most machines have complicated structures, and the position to work with is often distant from a user. If a body of a hand tool is not long enough to hold on, operating will be laborious and difficult. Besides, the space of operating is often small and narrow. If the body of a hand tool is long enough, the body is often obstructed by other components of the machine. In that, the body of the hand tool is difficult to operate.

A bendable hand tool is disclosed in U.S. Pat. No. 6,167,787. The bending angle of the bendable hand tool is able to be adjusted by pivoting. Specifically, the working head is able to pivot with respect to the handle due to the teeth engagement therebetween. However, the teeth engagement has to be positioned by switching the thumb lock manually before working to keep the bending angle. Furthermore, the teeth engagement provides an engaging force which is too weak to keep the bending angle. During operation, the teeth may be abraded easily so that the abraded teeth may be fail to perform an ability of engaging.

SUMMARY OF THE INVENTION

The main object of the present invention is to provide a handtool having bending mechanism which is easy to operate.

To achieve the above and other objects, a. handtool having bending mechanism of the present invention includes a first element and a second element.

A first direction is defined by a longitudinal direction of the first element. The first element has a pivot end at an end along the first direction. A second direction is defined by a longitudinal direction of the second element. The second element has a pivot trough at an end along the second direction. The pivot trough has a breach on a side wall of the pivot trough wherein the breach is opened. The pivot end is pivotably disposed in the pivot trough. The pivot end is able to move in the pivot trough between a restriction position and a pivotable position. The pivot end is hindered by a bottom of the pivot trough so as to fail to pivot with respect to the pivot trough when the pivot end is located at the restriction position. The pivot end is not hindered by the bottom of the pivot trough so as to able to pivot with respect to the pivot trough via the breach.

Specifically, an external wall of the pivot end is formed with a sliding groove. A longitudinal direction of the sliding groove is parallel to the first direction. An internal wall of the pivot trough is formed with a first positioning notch. A restriction element is disposed in the first positioning notch and is partially located in the pivot trough to be slidable received in the sliding groove in order to restrict the pivot end between the restriction position and the pivotable position. The external wall of the pivot end is further formed with a receiving hole. A first elastic element and a positioning element are received in the positioning hole. The positioning element is pushed by the first elastic element so as to tend to move outward. The internal wall of the pivot trough is further formed with a second positioning notch. When the pivot end is located at the pivotably position, the second positioning notch positionally corresponds to the positioning element so that the positioning element is partially received in the second positioning notch.

Thereby, the handtool of the present invention can be easily bent by moving pulling the first element with respect to the second element for pivotability. Furthermore, when the first element is pushed back to the second element, the pivotability is hindered without any other positioning mechanism and operation. Thus, the handtool of the present invention is easier to use.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
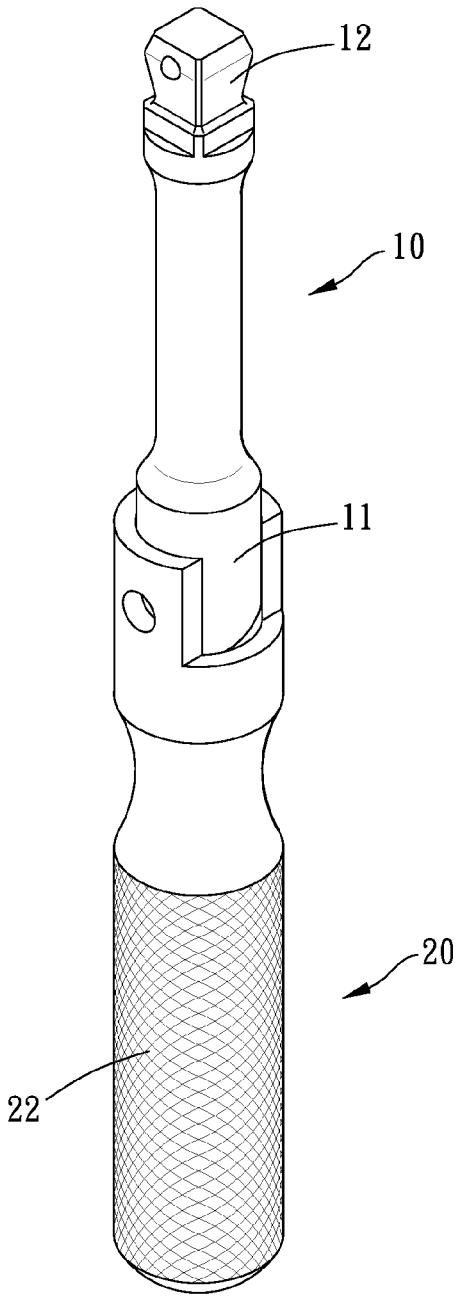
FIG. 1 is a stereogram of the present invention.
Figure 2:
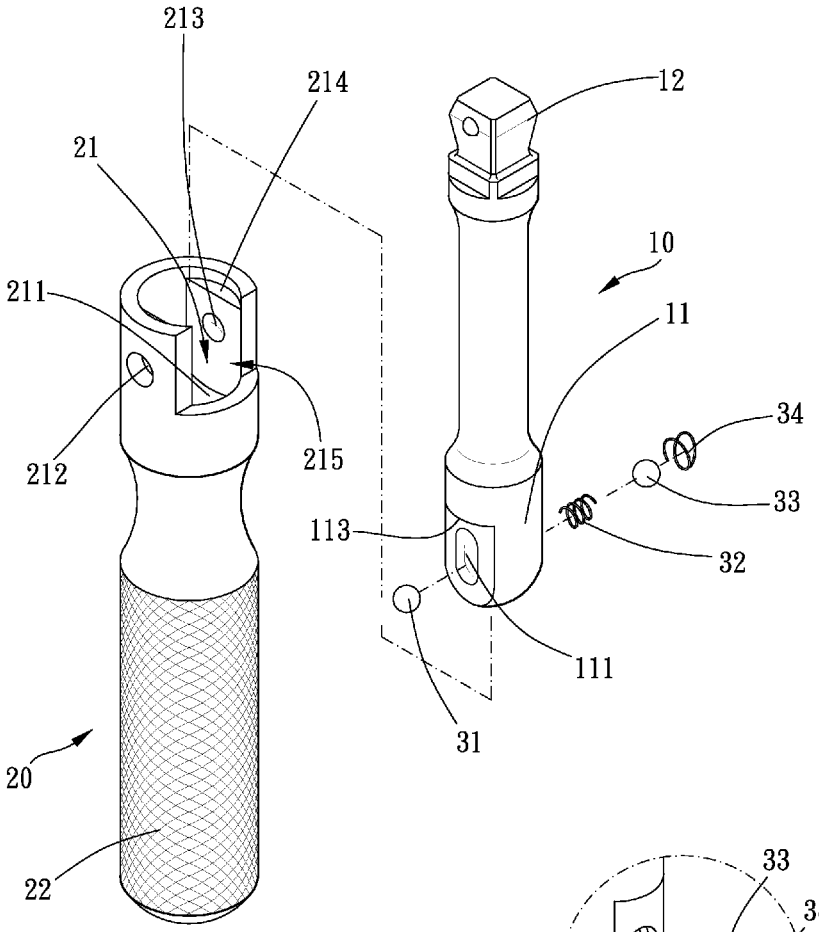
FIG. 2 is a breakdown drawing of the present invention.
Figure 2A:
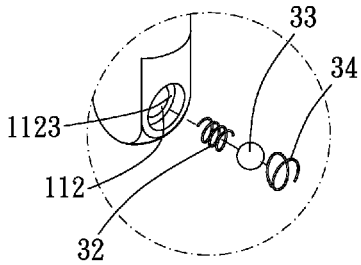
FIG. 2A is a partial enlargement view of FIG. 2.
Figure 3:
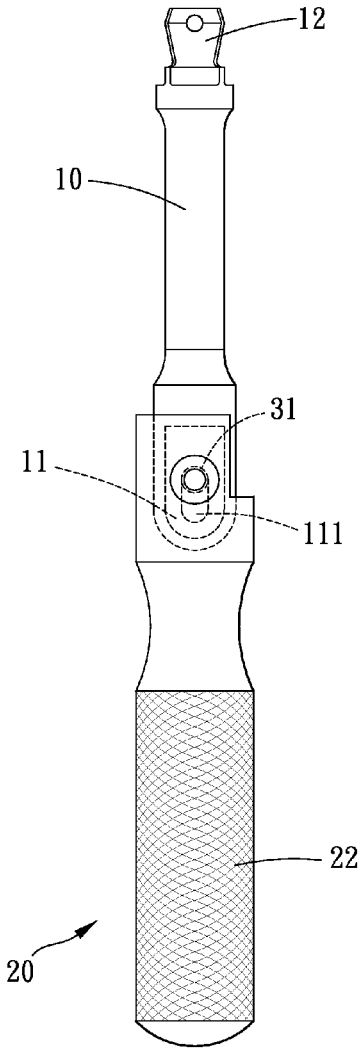
FIG. 3 is a side view of the present invention when a pivot end is located at a restriction position.
Figure 3A:
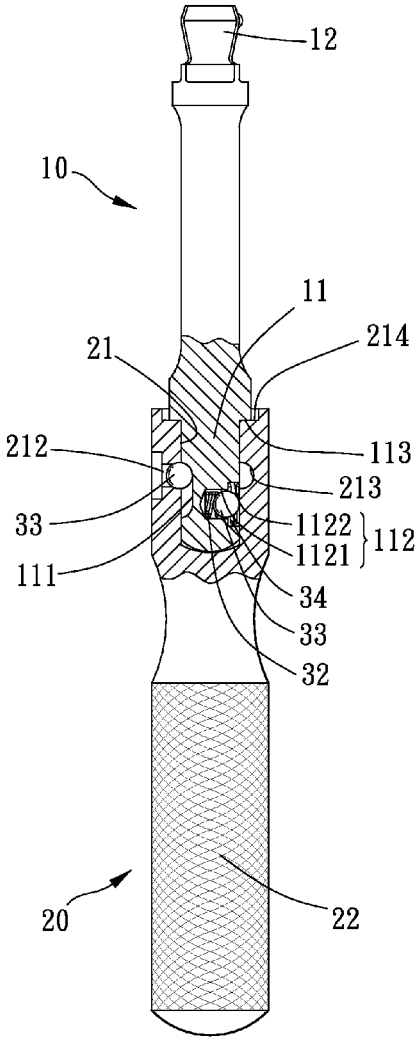
FIG. 3A is a partial perspective view of the present invention when a pivot end is located at a restriction position.
Figure 4:
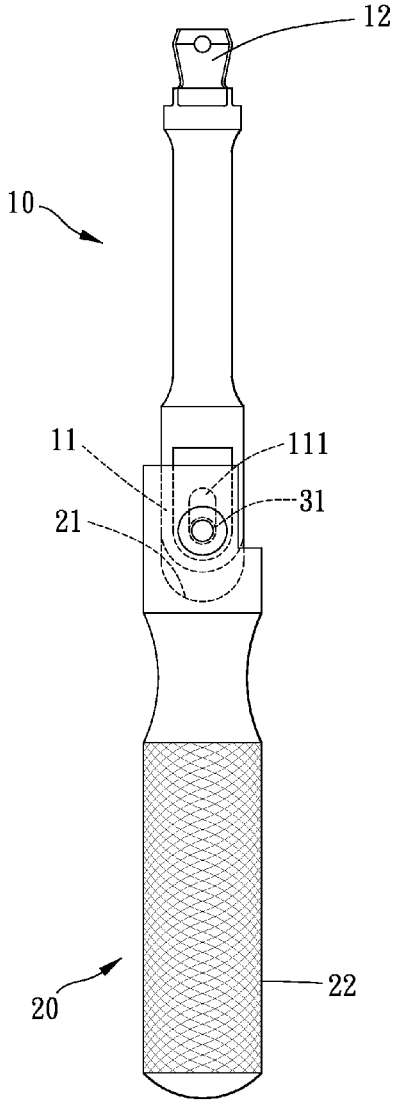
FIG. 4 is a side view of the present invention when a pivot end is located at a pivotable position.
Figure 4A:
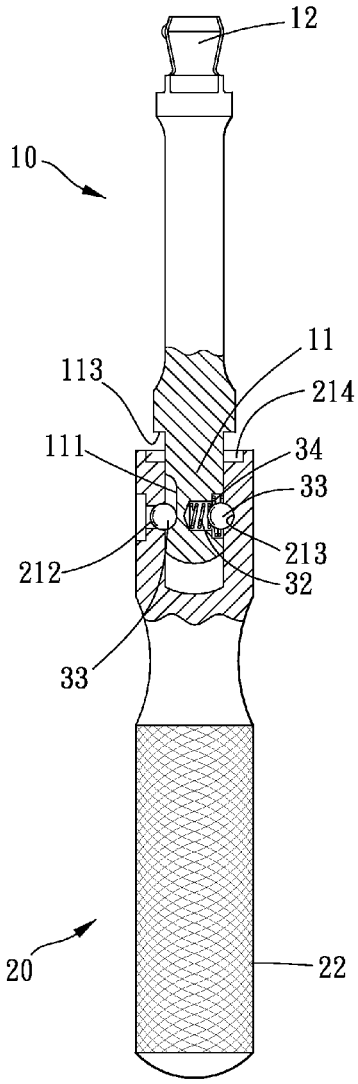
FIG. 4A is a partial perspective view of the present invention when a pivot end is located at a pivotable position.
Figure 5:
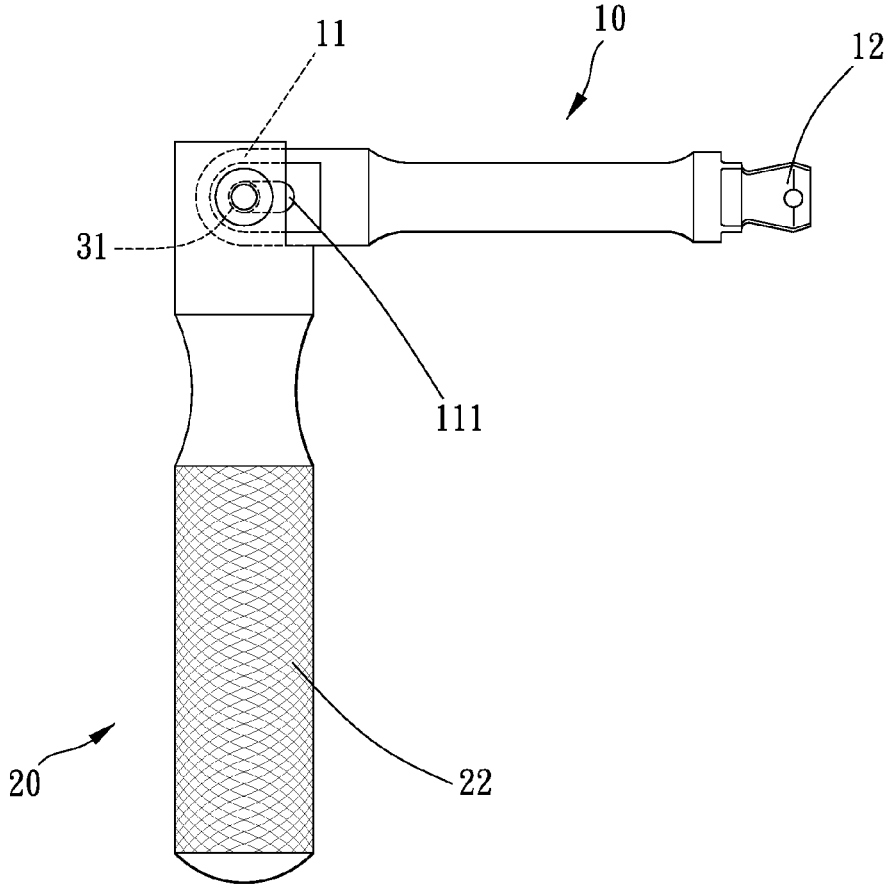
FIG. 5 is an illustration of bending of the present invention.
Figure 6:
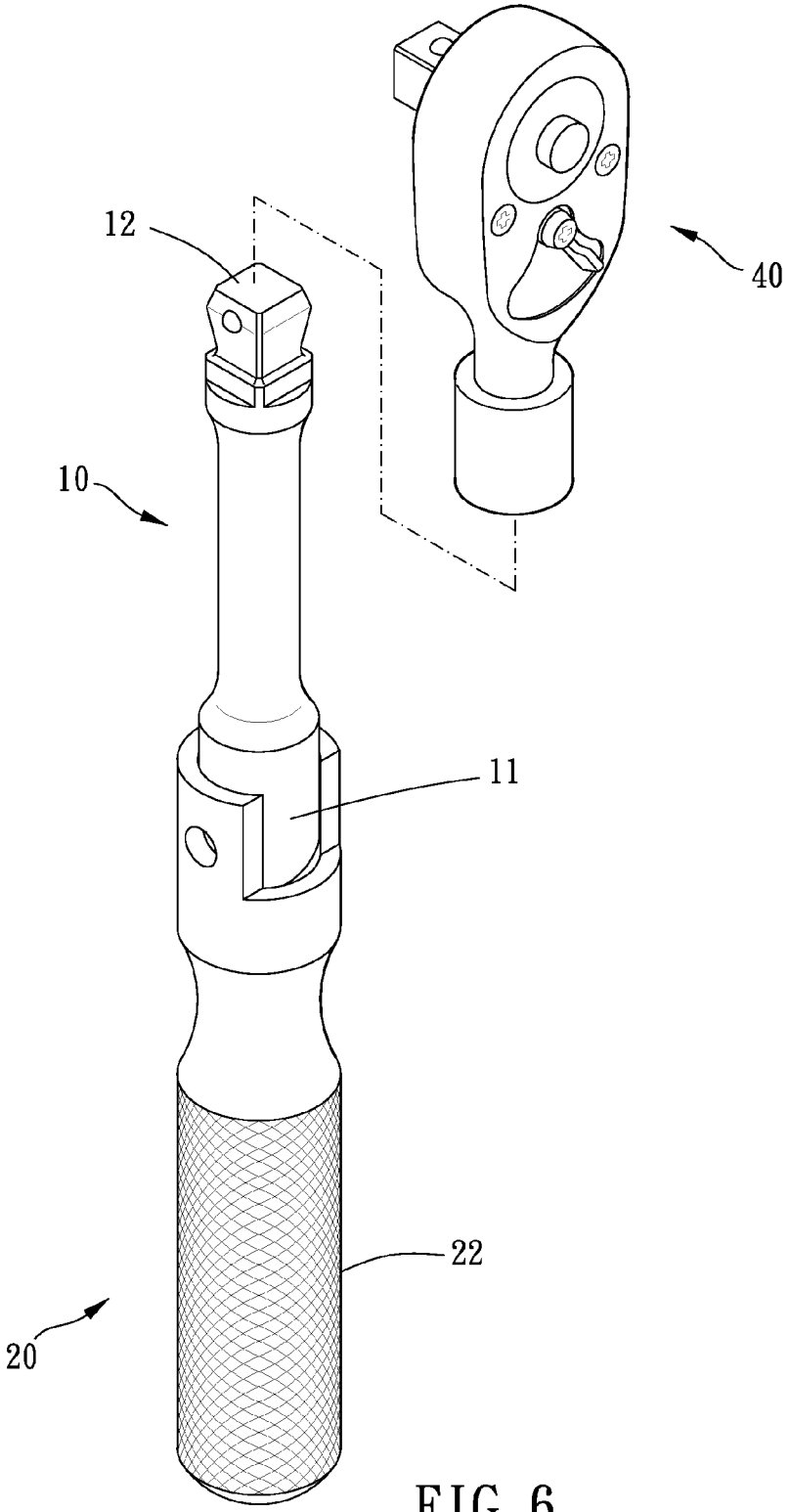
FIG. 6 is an illustration of the present invention.

Please refer to FIG. 1 to FIG. 6, the handtool having bending mechanism of the present invention includes a first element 10 and a second element 20.

The first element 10 is preferably rod-shaped and defines a first direction by a longitudinal direction thereof. An end of the first element 10 along the first direction is a pivot end 11. More specifically, in the present embodiment, an end of the first element opposite to the pivot end 11 is a working portion 12 for connecting with a tool head 40 such as a ratchet wrench head.

The second element 20 is preferably rod-shaped and defines a second direction by a longitudinal direction thereof. An end of the second element 20 along the second direction is a pivot trough 21 having a breach 215 on a side wall thereof wherein the breach 215 is opened. In the present embodiment, an end of the second element 20 opposite to the pivot trough 21 is a holding portion 22. The pivot trough 21 has an opening facing opposite to the holding portion 22. The pivot end 11 of the first element 10 is pivotally disposed in the pivot trough 21 and is movable in the pivot trough 21 between a restriction position and a pivotable position along the second direction. When the pivot end 11 is located at the restriction position, the pivot end 11 is hindered by a bottom 211 of the pivot trough 21 so as to fail to pivot with respect to the pivot trough 21. On the contrary, when the pivot end 11 is located at the pivotable position, the pivot end 11 is not hindered by the bottom 211 of the pivot trough 21 so as to be pivotable with respect to the pivot trough 21 via the breach 215. In the present embodiment, when the pivot end 11 is located at the restriction position, the terminal end of the pivot end 11 abuts against the bottom 211 of the pivot trough 21. When the pivot end 11 is located at the pivotable position, the terminal end of the pivot end 11 is away from the bottom 211 of the pivot trough 21.

More specifically, a sliding groove 111 and a receiving hole 112 are formed on two opposite external walls of the pivot end 11 respectively, and first positioning notch 212 and a second positioning notch 213 are formed on the internal wall of the pivot trough 21. The sliding groove 111 positionally corresponds to the receiving hole 112. The sliding groove 111 has a longitudinal direction parallel to the first direction. A restriction element 31 such as a rolling ball is disposed in the first positioning notch 212 and is partially located in the pivot trough 21 to be slidably disposed in the sliding groove 111 in order to restrict the pivot end 11 between the restriction position and the pivotable position. The receiving hole 112 receives a first elastic element 32 and a positioning element 33 such as a rolling ball. The first elastic element 32 pushes the positioning element 33 so that the positioning element 33 tends to move outward. When the pivot end 11 is located at the pivotable position, the second positioning notch 214 positionally corresponds to the positioning element 33, and the positioning element 33 is partially received in the second positioning notch 214. More preferably, the receiving hole 112 includes a reduced section 1121 and an expanded section 1122 wherein the reduced section 1121 is closer to a bottom of the receiving hole 112 than the expanded section 1122. A stepped face 1123 is formed between the expanded section 1122 and the reduced section 1121. The first elastic element 32 is received in the reduced section 1121, and a second elastic element 34 is received in the expanded section 1122. The second elastic element 34 abuts against the stepped face 1123 and the internal wall of the pivot trough 21 therebetween.

Thereby, when the pivot end 11 is located at the restriction position, the restriction element 31 is located at an end of the sliding groove 111 closer to the working portion 12. When the pivot end 11 is located at the pivotable position, the restriction element 31 is located at an end of the sliding groove 111 more remote from the working portion 12.

Furthermore, the first element 10 is formed with at least one leaning face 113, and the second element 20 is formed with at least one abutting face 214 near the opening of the pivot trough 21. The leaning face 113 and the abutting face 214 face each other. When the pivot end 11 is located at the restriction position, the leaning face 113 and the abutting face 214 abut against each other to hinder the pivotability of the first element 10. When the pivot end 11 is located at the pivotable position, the leaning face 113 and the abutting face 214 are away from each other.

In the present embodiment, when the pivot end 11 is located at the restriction position, the first direction is parallel to the second direction. That is, the first element 10 and the second element 20 are aligned as a straight line. When the pivot end 11 is moved to the pivotable position, the pivot end 11 is able to pivot about the restriction element 31 and the positioning element 33 with respect to the pivot trough 21 via the breach 215 so that the first element 10 is substantially perpendicular to the second element 20. Thus, the first element 10 and the second element 20 are substantially L-shaped. To achieve the goal, the first positioning notch 212 and the second positioning notch 213 are located at two opposite sides of the breach 215. That is, the breach 215 is located between the first positioning notch 212 and the second positioning notch 213.

In use, to make the first element 10 pivotable, one can pull the first element 10 away from the second element 20 to move the pivot end 11 to the pivotable position. Thereby, the first element 10 is pivotable to make the handtool of the present invention bendable. On the contrary, one can make the first element 10 parallel to the second element 20 and then push the first element 10 toward the second element 20 to move the pivot end 11 to the restriction position. Thus, the first element 10 is unable to pivot with respect to the pivot trough 21 so that the first element 10 is positioned to the second element 20.

Figure 7:
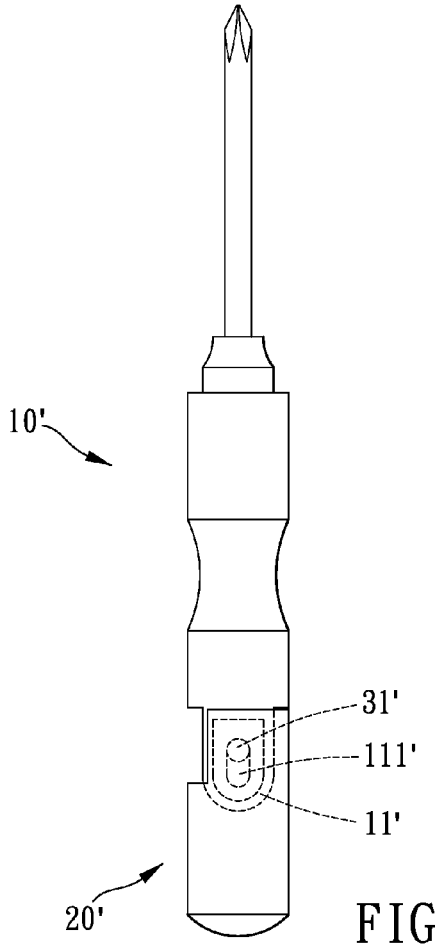
FIG. 7 is an illustration of a second embodiment of the present invention.
Figure 7A:
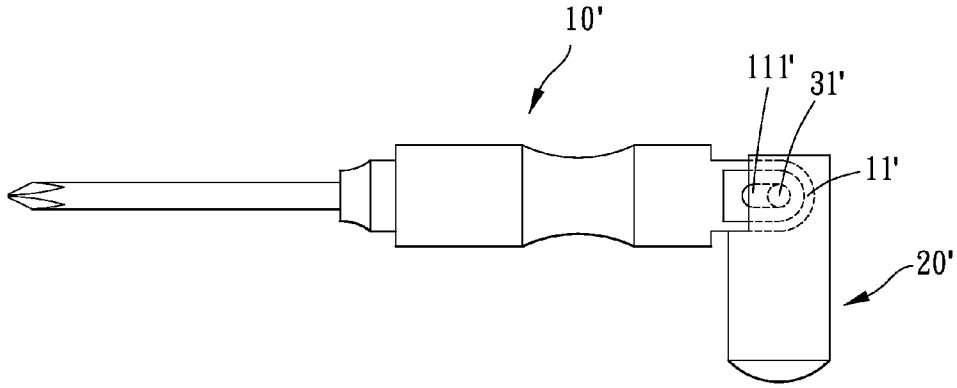
FIG. 7A is an illustration of bending of a second embodiment of the present invention.

Please refer to FIG. 7 and FIG. 7A for a second embodiment of the present invention, the first element 10' and the second element 20' are formed as an integrate tool such as a screwdriver or spanners. The tool can be bent by a similar manner as recited in previous paragraphs. Specifically, the restriction element 31', the sliding groove 111', the pivot end 11', and other components of the bending mechanism are disposed in the tool to enable the tool bendable.

In conclusion, the present invention provides a bending mechanism which is easier to operate. Also, positioning mechanism and operation for positioning are not necessary in the present invention. A user can easily pull or push the first element with respect to the second element for acquiring bendability or restricting the pivotability.

What is claimed is:

1. A handtool having bending mechanism, including:

a first element, a first direction being defined by a longitudinal direction of the first element, the first element having a pivot end at an end along the first direction;

a second element, a second direction being defined by a longitudinal direction of the second element, the second element having a pivot trough at an end along the second direction, the pivot trough having a breach on a side wall of the pivot trough wherein the breach is opened, the pivot end being pivotably disposed in the pivot trough, the pivot end being able to move in the pivot trough between a restriction position and a pivotable position, the pivot end being hindered by a bottom of the pivot trough so as to fail to pivot with respect to the pivot trough when the pivot end is located at the restriction position, the pivot end being not hindered by the bottom of the pivot trough so as to able to pivot with respect to the pivot trough via the breach;

wherein an external wall of the pivot end is formed with a sliding groove, a longitudinal direction of the sliding groove is parallel to the first direction, an internal wall of the pivot trough is formed with a first positioning notch, a restriction element is disposed in the first positioning notch and is partially located in the pivot trough to be slidable received in the sliding groove in order to restrict the pivot end between the restriction position and the pivotable position, the external wall of the pivot end is further formed with a receiving hole, a first elastic element and a positioning element are received in the positioning hole, the positioning element is pushed by the first elastic element so as to tend to move outward, the internal wall of the pivot trough is further formed with a second positioning notch, when the pivot end is located at the pivotably position, the second positioning notch positionally corresponds to the positioning element so that the positioning element is partially received in the second positioning notch.

2. The handtool having bending mechanism of claim 1, wherein the first element has at least one leaning face, the second element has at least one abutting face at an opening of the pivot trough, the leaning face and the abutting face face each other, the leaning face and the abutting face abut against each other when the pivot end is located at the restriction position, the leaning face and abutting face leave each other when the pivot end is located at the pivotable position.

3. The handtool having bending mechanism of claim 1, wherein the first element has a working portion at an end thereof opposite to the pivot end, the second element has a holding portion at an end thereof opposite to the pivot trough, the restriction element is located at an end of the sliding groove closer to the working portion when the pivot end is located at the restriction position, the restriction element is located at an end of the sliding groove more remote from the working portion when the pivot end is located at the pivotable position.

4. The handtool having bending mechanism of claim 1, wherein a terminal end of the pivot end abuts against the bottom of the pivot trough when the pivot end is located at the restriction position, the terminal end of the pivot end is away from the bottom of the pivot trough when the pivot end is located at the pivotable position.

5. The handtool having bending mechanism of claim 1, wherein the receiving hole includes a reduced section and an expanded section wherein an internal diameter of the reduced section is smaller than an internal diameter of the expanded section, the reduced section is more closer to a bottom of the receiving hole than the expanded section, a stepped face is formed between the reduced section and the expanded section, the first elastic element is received in the reduced section, the expanded section is received with a second elastic element, the second elastic abuts against the stepped face and the internal wall of the pivot trough therebetween.

6. The handtool having bending mechanism of claim 1, wherein the sliding groove and the receiving hole are formed on two opposite side walls of the pivot end respectively, the sliding groove positionally corresponds to the receiving hole.

7. The handtool having bending mechanism of claim 1, wherein each of the restriction element and the positioning element is a rolling ball.

* * * * *